US006678969B1

(12) United States Patent
Hong

(10) Patent No.: US 6,678,969 B1
(45) Date of Patent: Jan. 20, 2004

(54) CLOTHES DRYER

(75) Inventor: Sang Wook Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/348,952

(22) Filed: Jan. 23, 2003

(30) Foreign Application Priority Data

Aug. 13, 2002 (KR) ..... P10-2002-0047801

(51) Int. Cl.[7] ..... F26B 11/02

(52) U.S. Cl. ..... 34/595; 34/596; 34/604; 34/606; 34/108; 34/114; 34/134; 34/235; 34/82

(58) Field of Search ..... 34/595, 596, 604, 34/606, 108, 114, 134, 235, 82; 432/105, 103, 113; 110/246

(56) References Cited

U.S. PATENT DOCUMENTS 5,185,940 A * 2/1993 Fleissner ..... 34/115
6,154,978 A * 12/2000 Slutsky ..... 34/321
2003/0000105 A1 * 1/2003 Song et al. ..... 34/595
2003/0037460 A1 * 2/2003 Song et al. ..... 34/595

* cited by examiner

*Primary Examiner*—Jiping Lu
(74) *Attorney, Agent, or Firm*—Fleshner & Kim, LLP

(57) ABSTRACT

A clothes dryer is disclosed, in which the clothes dryer comprising a first and second connecting ducts communicating with a drum, respectively, a first flow passage control device to communicate a heating duct with the first connecting duct or with the second connecting duct, and a second flow passage control device to communicate an exhaust duct with the first connecting duct or with the second connecting duct. When the first flow passage control device is operated to communicate the heating duct with the first connecting duct, the second flow passage control device is operated to communicate the exhaust duct with the second connecting duct. When the first flow passage control device is operated to communicate the heating duct with the second connecting duct, the second flow passage control device is operated to communicate the exhaust duct with the first connecting duct.

18 Claims, 6 Drawing Sheets

CLOTHES DRYER

This application claims the benefit of the Korean Application No. P2002-47801 filed on Aug. 13, 2002, which is hereby incorporated by reference.

BACKGROUND OF THE INVENTION

1. Field of the Invention

The present invention relates to a clothes dryer, and more particularly, to a clothes dryer in which a hot blast is used to dry a dry object.

2. Description of the Related Art

Generally, a clothes dryer is an apparatus for automatically drying a dry object after a washing process. There are two different types of clothes dryers: a discharge type clothes dryer in which an external air is introduced to perform a dry process and a condensation type clothes dryer in which an internal air is circulated for the dry process and a moisture is condensed to a waterdrop to be discharged.

A discharge type clothes dryer of the prior art will be described below in reference to the accompanying drawings.

Referring to FIGS. 1 and 2, a prior art clothes dryer of the discharge type comprises a cabinet 1, a drum 3, a driving device, a heater 5, a suction duct 7, an exhaust duct 15, a lint duct 8, and a blast fan 13.

At this time, a door 2 is provided on the front side of the cabinet 1. The drum 3 is rotatably provided in the cabinet 1 and a plurality of tumbling ribs 4 are provided on the inner circumferential face of the drum 3. The driving device being provided to provide a rotating force to the drum 3 includes a motor 10, a driving pulley 11 coupled to the motor 10, and a belt 12 being connected to the driving pully 11 and winding the outer circumferential face of the drum 3. When the driving device is operated, the driving pulley 11 is rotated by the rotation of the motor 10, thereby rotating the belt 12 and the drum 3 as well.

As shown in FIG. 1, the heater 5 is provided in the suction duct 7 to produce a hot blast by heating sucked air to a high temperature. The suction duct 7 communicating with a rear opening of the drum 3 sucks external air through its one end and guides a hot blast generated by the heater 5 into the drum 3. The exhaust duct 15 communicates with an outside of the cabinet 1. The lint duct 8 is provided to respectively communicate with a front opening of the drum 3 and the exhaust duct 15 so as to guide humid air after a dry process to the exhaust duct 15. A filter 14 is provided on an opening of the lint duct 8 to filter 14 off lint particles from the air being exhausted from the drum 3. The blast fan 13 being provided on the rear side of the lint duct 8 exhausts the humid air being guided to the exhaust duct 15 by generating a blast force.

A drying process of a clothes dryer according to the prior art will be described below.

First, the dry object is put into the drum 3. Then, as a dry process is started, the motor 10 is operated and the drum 3 is rotated. According to this, the heater 5 and the blast fan 13 are also operated. As shown in FIG. 2, as the blast fan 13 starts operating, external air is sucked into the cabinet 1 and heated by the heater 5. The heated air becomes a hot blast and is introduced into the drum 3 being rotating. The hot blast in the drum 3 evaporates the moisture of the dry object. In this way, the hot blast becomes humid air of a low temperature being exhausted to the exterior through the lint duct 8 and exhaust duct 15.

However, the clothes dryer according to the prior art has some problems or disadvantages. In the clothes dryer according to the prior art, a hot blast flows in one direction to the drum 3, from a rear side to a front side, to perform a dry process. Accordingly, the temperature difference between a hot blast inlet on the rear side of the drum 3 and a hot blast outlet on the front side of the drum 3 becomes larger. For that reason, in the drum 3, the dry object on the rear side is rapidly dried while the dry object on the front side is very slowly dried. Accordingly, the dry process is performed unevenly depending on the position inside the drum 3 and occasionally, in the worst case, the dry object may be damaged.

To overcome such a problem as the uneven dry process of the prior art, various operation control methods have been introduced, in which a cooling process is added during the dry process. However, the operation control method is not enough to fundamentally work out the problem and also can result in other problems such as increased dry processing time and low energy efficiency.

SUMMARY OF THE INVENTION

Accordingly, the present invention is directed to a clothes dryer that substantially obviates one or more problems due to limitations and disadvantages of the prior art.

An object of the present invention is to provide a clothes dryer that prevents an uneven dry phenomenon and possible damage of a dry object and reduces dry processing time.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a clothes dryer of the present invention comprising a cabinet, a drum, first and second connecting ducts, a heating duct, an exhaust duct, and first and second flow passage control devices. The drum is rotatably provided in the cabinet. The first connecting duct is connected with a rear side of the drum to communicate with an inside space of the drum and the second connecting duct is connected with a front side of the drum to communicate with the inside space of the drum. The heating duct provides air to the drum. The exhaust duct exhausts the air which passes through the drum to an outside of the cabinet. The first flow passage control device communicates the heating duct with the first connecting duct or with the second connecting duct selectively. The second flow passage control device communicates the exhaust duct with the first connecting duct or with the second connecting duct selectively.

A heater for heating the air is provided in the heating duct. A blast fan for circulating the air is provided in the exhaust duct.

The first and second flow passage control devices include solenoid valves being operated according to a control signal of a controller.

Also, a first guide duct is provided to communicate the heating duct with the first and the second connecting duct. The first flow passage control device is provided in the part where the first guide duct and the heating duct communicate with each other.

Additionally, a second guide duct is provided to communicate the exhaust duct with the first and the second connecting duct. The second flow passage control device is provided in the part where the second guide duct and the exhaust duct communicate with each other.

At this instance, when the first flow passage control device is operated to communicate the heating duct with the first connecting duct, the second flow passage control device is operated to communicate the exhaust duct with the second connecting duct. When the first flow passage control device is operated to communicate the heating duct with the second connecting duct, the second flow passage control device is operated to communicate the exhaust duct with the first connecting duct.

Also, a filtering device is provided for filtering the air. The filtering device includes first and second filters. The first filter is provided in the part where the first connecting duct and the second guide duct communicate with each other. The second filter is provided in the part where the second connecting duct and the second guide duct communicate with each other. A third filter is additionally provided in the heating duct.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
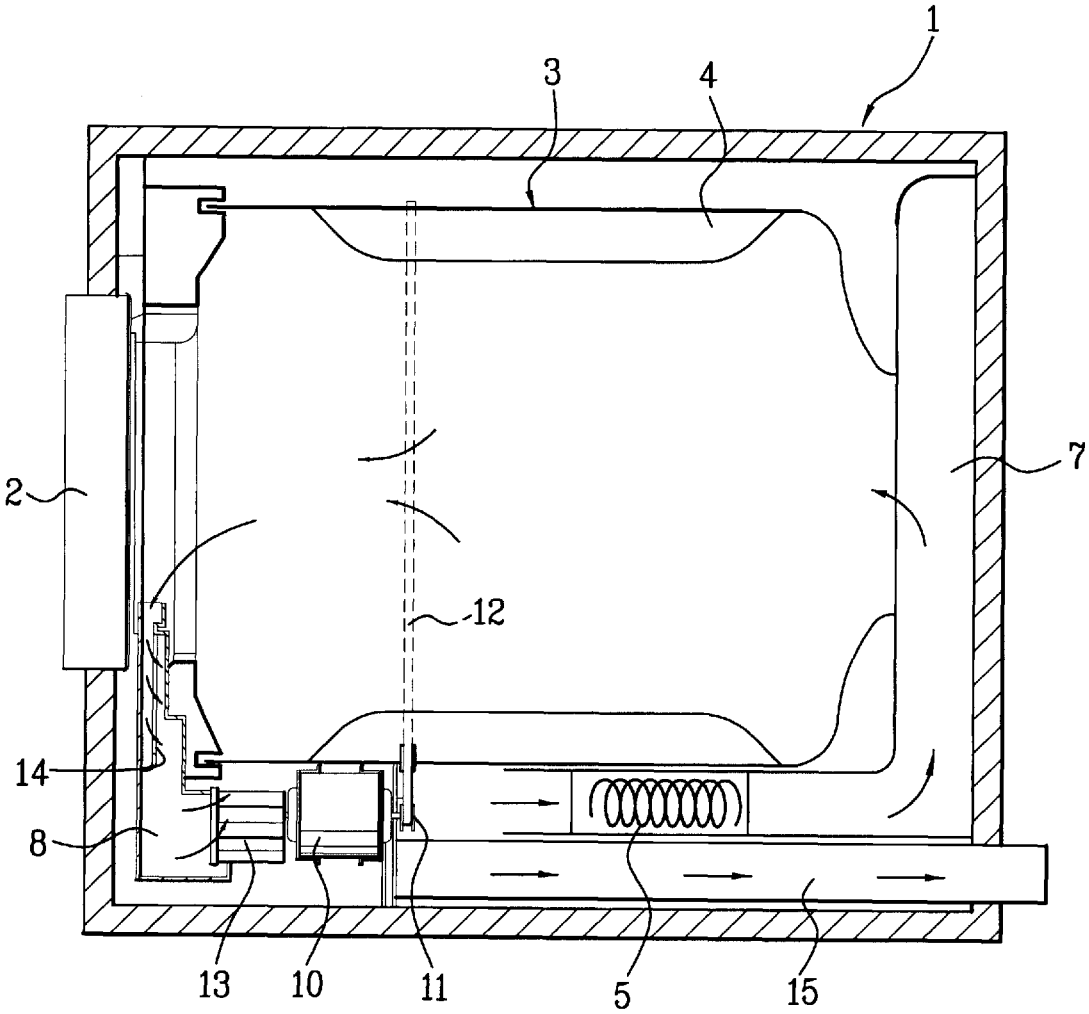
FIG.1 Prior Art
FIG. 1 is a longitudinal-sectional view illustrating a clothes dryer of the prior art.
Figure 2:
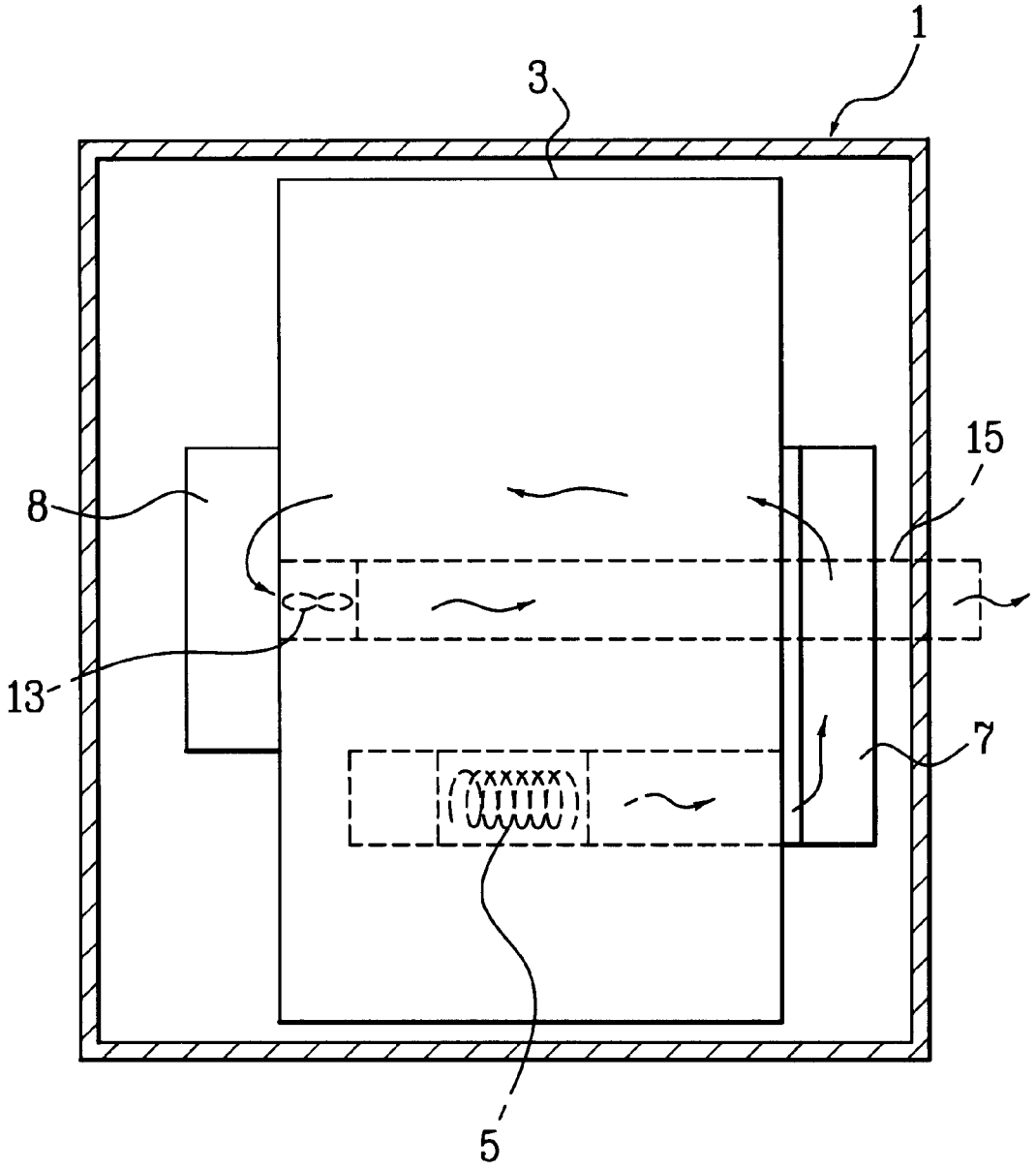
FIG.2 Prior Art
FIG. 2 is a cross-sectional view illustrating main parts of a flow passage structure of the clothes dryer of FIG. 1.

Reference will now be made in detail to the preferred embodiments of the present invention, examples of which are illustrated in the accompanying drawings. Wherever possible, the same reference numbers will be used throughout the drawings to refer to the same or like parts.

FIGS. 3 to 6 illustrate an inner structure of a flow passage of a clothes dryer in accordance with the present invention. Referring to the drawings, a door 101 is provided on a front side of a cabinet 100 of the clothes dryer and a drum 103 is rotatably provided in the cabinet 100. A first connecting duct 107 is connected with a rear side of the drum 103 so as to communicate with an inside space of the drum 103 and a second connecting duct 108 is connected with a front side of the drum 103 so as to communicate with the inside space of the drum 103.

At this instance, the drum 103 is rotated by the control of a separate driving device (not shown) such as a motor being controlled by a controller (not shown). Because the structure and operation of the driving device of the present invention are similar to those of a driving device of the prior art, any additional description on it will be omitted.

In the meantime, first and second guide ducts 109 and 110 opposite to each other are provided along two sides inside the cabinet 100. Each one end of the first and second guide ducts 109 and 110 communicates with the first connecting duct respectively and each of the other ends of them communicates with the second connecting duct 108 respectively.

A heating duct 106 with one end communicating with a middle portion of the first guide duct 109 and the other end communicating with an outside of the cabinet 100 has a heater 105 therein to heat air sucked into therein.

Figure 3:
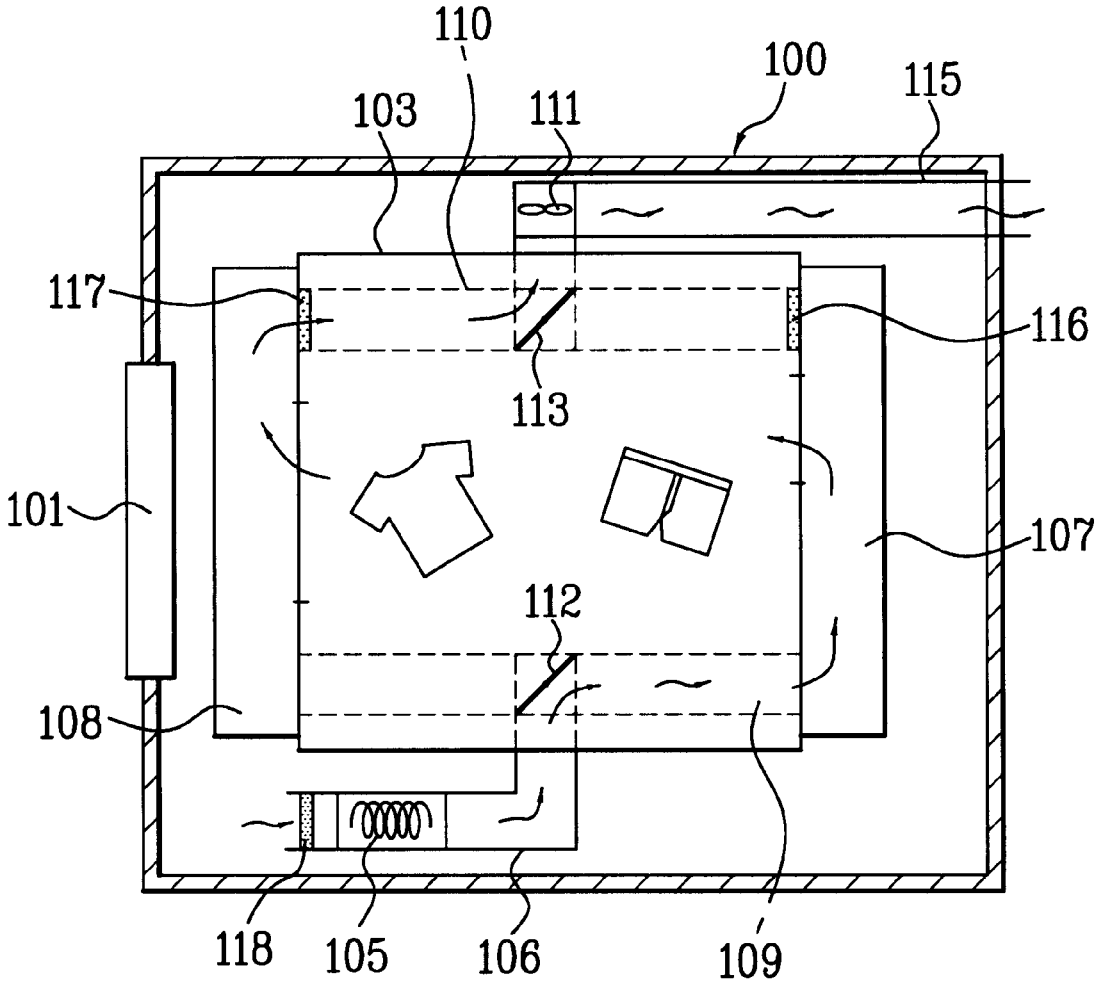
FIG. 3 is a cross-sectional view illustrating a flow passage structure of a clothes dryer in accordance with the first embodiment of the present invention.

As shown in FIG. 3, a first flow passage control device 112 is provided the part where the first guide duct 109 and the heating duct 106 communicate with each other. The first flow passage control device 112 communicates the heating duct 106 with the first connecting duct 107 or with the second connecting duct 108, thereby changing a flow passage of the air being heated by the heater 105. The first flow passage control device 112 includes a solenoid valve electrically operated according to a signal of the controller.

The exhaust duct 115 has one end communicating with the middle part of the second guide duct 110 and the other end communicating with the outside of the cabinet 100. A blast fan 111 is provided inside the exhaust duct 115, by which the air sucked through the heating duct 106 is exhausted to the outside of the cabinet 100. The air being sucked through the heating duct 106 passes through the drum 103 and exhausted to the outside of the cabinet 100 by a blast force of the blast fan 111.

As shown in FIG. 3, a second flow passage control device 113 is provided in the part where the second guide duct 110 and the exhaust duct 115 communicates with each other. The second flow passage control device 113 communicates the exhaust duct 115 with the first connecting duct 107 or with the second connecting duct 108, thereby changing a flow passage of the air, the air being exhausted to the outside of the cabinet 100 by the blast fan 111. The second flow passage control device 113 includes a solenoid valve electrically operated according to a signal of the controller.

Figure 5:
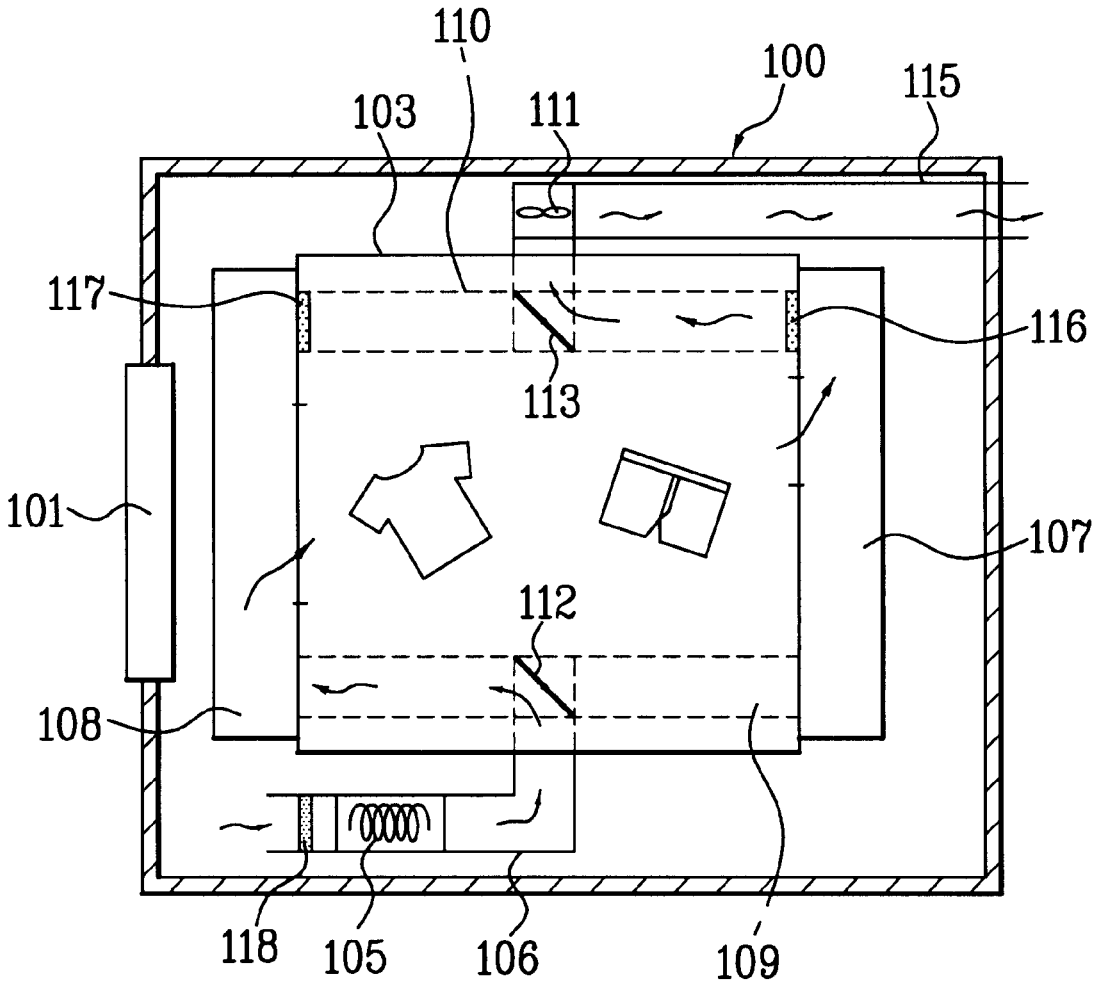
FIG. 5 is a cross-sectional view illustrating the flow passage of FIG. 3, the flow passage of which direction is reversed.

At this instance, as shown in FIGS. 3 and 5, when the first flow passage control device 112 is operated to communicate the first connecting duct 107 with the heating duct 106, the second flow passage control device 113 is operated to communicate the second connecting duct 108 with the exhaust duct 115. When the first flow passage control device 112 is operated to communicate the second connecting duct 108 with the heating duct 106, the second flow passage control device 113 is operated to communicate the first connecting duct 107 with the exhaust duct 115.

Also, a filtering device is provided for filtering the air being exhausted to the exhaust duct 115 and includes first and second filters 116 and 117. The first filter 116 is provided in the part where the first connecting duct 107 and the second guide duct 110 communicate with each other. The second filter 117 is provided in the part where the second connecting duct 108 and the second guide duct 110 communicate with each other.

A third filter 118, as shown in FIG. 3, is additionally provided in the heating duct 106 for filtering the air being sucked into the clothes dryer through the heating duct 106. The third filter 118 is provided in an end of a sucking part of the heating duct 106.

The operation of a clothes dryer with the above structure will be described below.

Figure 4:
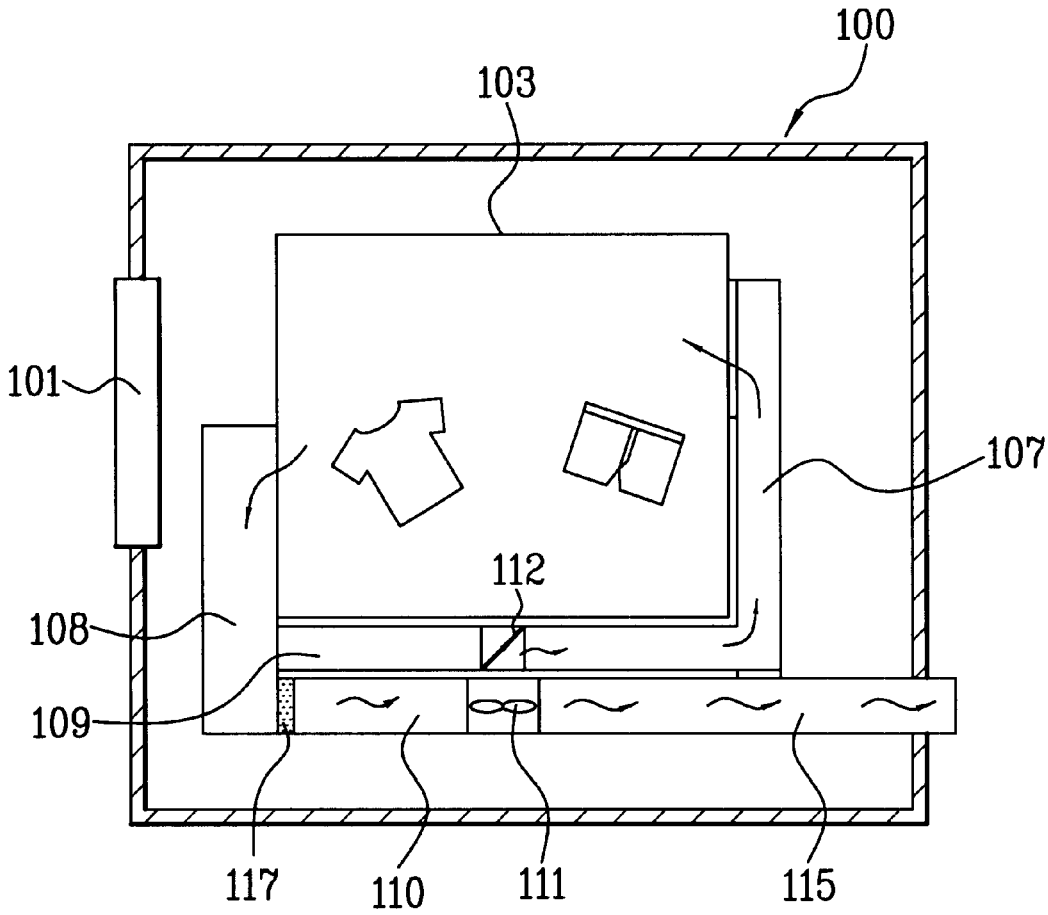
FIG. 4 is a longitudinal-sectional view illustrating main parts of the flow passage structure of the clothes dryer of FIG. 3.

As shown in FIGS. 3 and 4, before the clothes dryer is operated, a first flows passage control device 112 communicates the heating duct 106 with the first connecting duct 107. Also, the second flow passage control device 113 communicates an exhaust duct 115 with the second connecting duct 108.

When a dry process is started as a user put a dry object into a drum 103, the drum 103 starts rotating to consistently mix the dry object therein.

Along with that, a blast fan 111 is operated by which the air is sucked into the clothes dryer through the heating duct 106. The sucked the air is heated by a heater 105 and becomes a hot blast. And, The hot blast is introduced into the drum 103 from the rear side of the drum after passing through a first guide duct 109 and the first connecting duct 107 according to the guide of the first flow passage control device 112. At this time, dusts in the air are filtered out through a third filter 118 and then, the air being filtered is introduced into the clothes dryer through the heating duct 106.

The hot blast being introduced into the drum 103 dries the dry object inside the drum 103. At this instance, however, the dry object on the rear side of the drum 103 is quickly dried and the dry object on the front side of the drum 103 is relatively slowly dried, thereby causing a difference in a dry state. In other words, depending on a position of the dry object in the drum 103, the dry object is dried at a different speed.

The air of high humidity and low temperature after the dry process is introduced into the second guide duct 110 through the second connecting duct 108 communicating with the front side of the drum 103. Lint particles in the air exhausted to the second guide duct 110 are filtered out through the second filter 117.

The air of high humidity and low temperature, being introduced into the second guide duct 110, is introduced to the exhaust duct 115 according to the guide of the second flow passage control device 113 and exhausted to the exterior by the blast fan 111.

In the meantime, if the dry process has been performed for predetermined time or the difference in a dry state of the dry object becomes large to a predetermined degree, the controller changes the position of the first and second flow passage control devices 112 and 113 in order to change a flow passage of the air.

Figure 6:
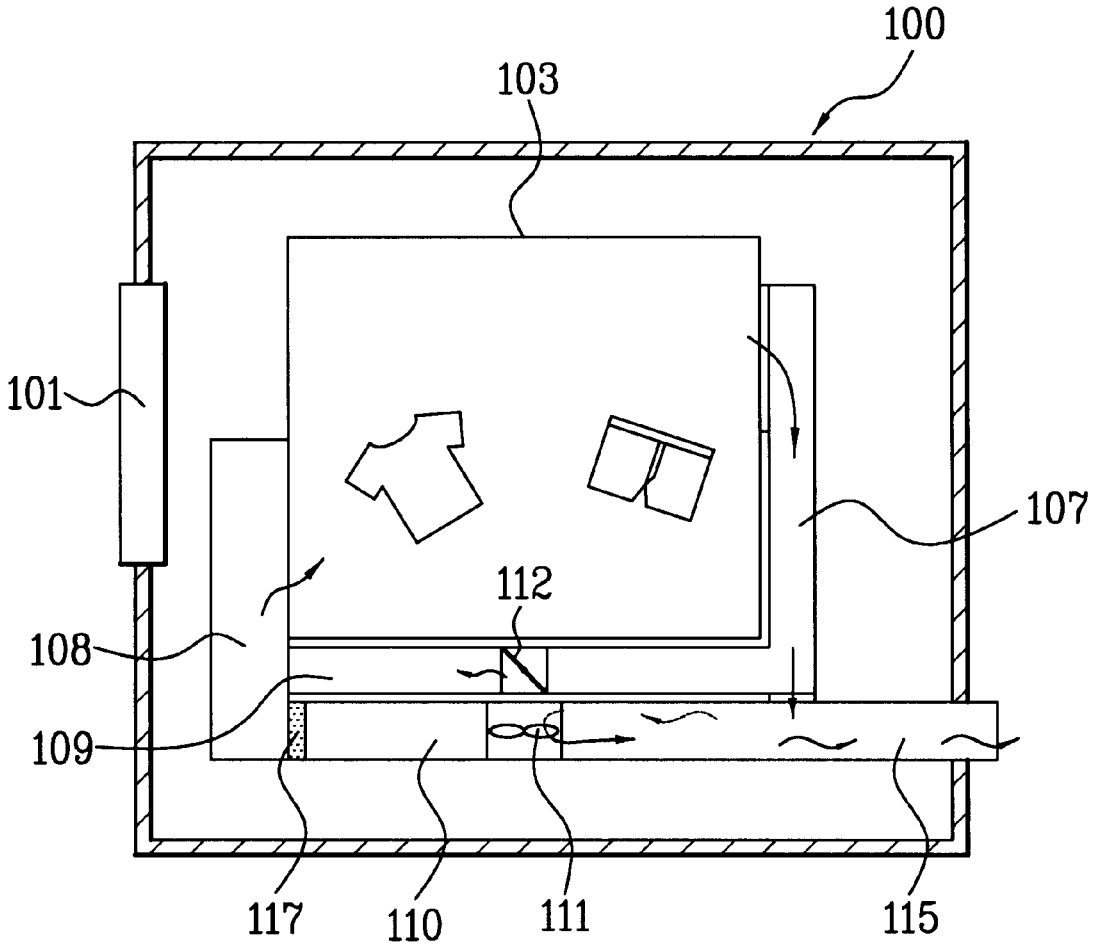
FIG. 6 is a longitudinal-sectional view illustrating the flow passage of FIG. 3, the flow passage of which direction is reversed.

In other words, as shown in FIGS. 5 and 6, the first flow passage control device 112 communicates the heating duct 106 with the second connecting duct 108 and the second flow passage control device 113 communicates the exhaust duct 115 with the first connecting duct 107. At this time, the first and second flow passage control devices 112 and 113 are operated automatically according to a control signal of the controller.

When the flow passage is changed as described above, the hot blast being introduced through the heating duct 106 is introduced into the drum 103 after passing through the first guide duct 109 and the second connecting duct 108 according to the guide of the first flow passage control device 112.

The hot blast being introduced into the drum 103 dries the dry object inside the drum 103. This time, however, the dry object on the rear side of the drum 103, which was quickly dried in the previous dry process, is slowly dried while the dry object on the front side of the drum 103, which was relatively slowly dried in the previous dry process, is quickly dried. Accordingly, the difference in the dry state is reduced.

The air of high humidity and low temperature after the dry process passes through the first connecting duct 107 and the second guide duct 110. Then, the air is exhausted to the outside of the cabinet 100 according to the guide of the second flow passage control device 113. Lint particles in the air being exhausted are filtered out through the first filter 116.

After the above process, if it is needed, after predetermined time passed or the difference in the dry state becomes large to a predetermined degree, the control part changes the flow passage and performs the dry process.

Therefore, in the present invention, an uneven dry phenomenon in the drum is prevented as the direction of the flow passage is changed once or a few times during the dry process. Accordingly, the dry object is prevented from being damaged and clothing of high quality can be dried in the clothes dryer of the present invention as well. Furthermore, the dry processing time is saved with no need of an intermediate cooling process for preventing damage of the laundry object and thus, energy efficiency increases.

It will be apparent to those skilled in the art that various modifications and variations can be made in the present invention.

For example, both ends of the first and second connecting ducts may be extended so as to be connected to the first and second flow passage control devices without forming the first and second guide ducts.

Also, one side of the first guide duct may be connected to the heating duct and one side of the second guide duct to the exhaust duct. On the opposite sides of them, the flow passage is divided into two, each of which respectively communicates with the first and second connecting ducts. At this instance, the first and second flow passage control devices are formed in a middle part of the first and second guide ducts respectively.

Thus, it is intended that the present invention covers the modifications and variations of this invention provided they come within the scope of the appended claims and their equivalents.

What is claimed is:

1. A clothes dryer, comprising:

a cabinet;

a drum being rotatably provided in the cabinet;

a first connecting duct being connected with a rear side of the drum to communicate with an inside space of the drum;

a second connecting duct being connected with a front side of the drum to communicate with the inside space of the drum;

a heating duct for providing air to the drum;

an exhaust duct for exhausting the air which passes through the drum to an outside of the cabinet;

a first flow passage control device for communicating the heating duct with the first connecting duct or with the second connecting duct selectively; and a second flow passage control device for communicating the exhaust duct with the first connecting duct or with the second connecting duct selectively.

2. The clothes dryer of claim 1, wherein, a heater for heating the air is provided in the heating duct.

3. The clothes dryer of claim 1, wherein, a blast fan for circulating the air is provided in the exhaust duct.

4. The clothes dryer of claim 1, wherein, the first flow passage control device includes a solenoid valve which is operated according to a control signal of a controller.

5. The clothes dryer of claim 1, wherein, the second flow passage control device includes a solenoid valve which is operated according to a control signal of a controller.

6. The clothes dryer of claim 1, further comprising a first guide duct having the first flow passage control device therein being provided to communicate the heating duct with the first connecting duct and the second connecting duct, respectively.

7. The clothes dryer of claim 6, wherein, the first flow passage control device is provided in a part where the first guide duct and the heating duct communicate with each other.

8. The clothes dryer of claim 6, further comprising a second guide duct having the second flow control device therein being provided inside the cabinet to communicate the exhaust duct with the first or second connecting duct.

9. The clothes dryer of claim 8, further comprising a filtering device being provided for filtering the air.

10. The clothes dryer of claim 9, wherein, the filtering device comprising a first filter being provided in a part where the first connecting duct and the second guide duct communicate with each other.

11. The clothes dryer of claim 9, wherein, the filtering device comprising a second filter being provided in a part where the second connecting duct and the second guide duct communicate with each other.

12. The clothes dryer of claim 9, wherein, the filtering device comprising a first filter being provided in the part where the first connecting duct and the second guide duct communicate with each other and a second filter being provided in the part where the second connecting duct and the second guide duct communicate with each other.

13. The clothes dryer of claim 8, further comprising a third filter being provided in the heating duct.

14. The clothes dryer of claim 1, further comprising a second guide duct having the second flow passage control device therein being provided to communicate the exhaust duct with the first connecting duct and the second connecting duct respectively.

15. The clothes dryer of claim 14, wherein, the second flow passage control device is provided in a part where the second guide duct and the exhaust duct communicate with each other.

16. The clothes dryer of claim 1, wherein, the second flow passage control device is operated to communicate the exhaust duct with the second connecting duct, when the first flow passage control device is operated to communicate the heating duct with the first connecting duct.

17. The clothes dryer of claim 1, wherein, the second flow passage control device is operated to communicate the exhaust duct with the first connecting duct, when the first flow passage control device is operated to communicate the heating duct with the second connecting duct.

18. A clothes dryer, comprising:

a cabinet;

a drum being rotatably provided in the cabinet;

a first connecting duct being connected with a rear side of the drum to communicate with an inside space of the drum;

a second connecting duct being connected with a front side of the drum to communicate with the inside space of the drum;

a heating duct for providing air to the drum;

an exhaust duct for exhausting the air which passes through the drum to an outside of the cabinet;

a first guide duct being provided to communicate the heating duct with the first connecting duct and the second connecting duct, respectively;

a second guide duct being provided to communicate the exhaust duct with the first connecting duct and the second connecting duct, respectively;

a first flow passage control device being provided in the first guide duct to communicate the heating duct with the first connecting duct or with the second connecting duct selectively; and a second flow passage control device being provided in the second guide duct to communicate the exhaust duct with the first connecting duct or with the second connecting duct selectively.

* * * * *